US005813797A

United States Patent [19]

Pendleton et al.

[11] Patent Number: 5,813,797

[45] Date of Patent: Sep. 29, 1998

[54] UNITARY SUMP FRAME

[75] Inventors: David Pendleton, Fairfield, Ohio; John Joseph Matracia, Edgewood, Ky.

[73] Assignee: Dover Corp., New York, N.Y.

[21] Appl. No.: 781,337

[22] Filed: Jan. 10, 1997

Related U.S. Application Data

[63] Continuation of Ser. No. 728,255, Oct. 8, 1996.

[51] Int. Cl.[6] ..... E02D 29/14; E02B 13/00; B65B 1/04

[52] U.S. Cl. ..... 405/52; 52/19; 52/20; 141/86; 404/26; 405/128; 405/303

[58] Field of Search ..... 405/52, 53, 128, 405/303, 154; 141/186, 188; 137/312, 313, 314; 52/19, 20; 404/2, 4, 25, 26

[56] References Cited

U.S. PATENT DOCUMENTS

| | | | |
|---|---|---|---|
| 2,236,667 | 4/1941 | Bikle | 52/19 |
| 3,702,211 | 11/1972 | Young et al. | 52/20 X |
| 3,975,870 | 8/1976 | Naka | 52/20 |
| 4,294,049 | 10/1981 | Young et al. | 52/20 |
| 4,505,814 | 3/1985 | Marshall | 404/26 X |
| 4,706,718 | 11/1987 | Milo | 137/314 X |
| 4,872,780 | 10/1989 | Bowman | 52/20 X |
| 4,989,634 | 2/1991 | Rieseck . | |
| 5,085,257 | 2/1992 | Smith | 52/19 X |
| 5,099,894 | 3/1992 | Mozeley | 137/312 X |
| 5,246,044 | 9/1993 | Robertson et al. | 141/86 |
| 5,257,652 | 11/1993 | Lawrence | 405/128 X |
| 5,398,976 | 3/1995 | Webb . | |
| 5,527,130 | 6/1996 | Webb . | |

OTHER PUBLICATIONS

Advanced Polymer Technology, Inc., Poly–Tech Split Dispenser Sumps, Pub. PDS201, Aug. 1, 1993, Elkhart, IN.

Environ Products Inc., GeoFlex Piping System, Pub. PM–0402, Feb. 1, 1994, Lionville, PA, various pages.

Total Containment, Inc., Dispenser Sumps, Pub. DS800, Sep. 1, 1994, Oaks, PA, various pages.

Total Containment, Inc., Pioneering Secondary Containment Systems for Future Generations, PB100, 4.95, Oaks, PA, various pages.

Environ Products, Inc., Dispenser Containment Manual, Pub. P–DCM–4030, May 15, 1995, Lionville, PA, various pages.

Environ Products, Inc., The GeoFlex System, Pub. P–APB–2010, Oct. 1, 1996, Lionville, PA, various pages.

Total Containment, US Price Manual, Pub. PM1500, Apr. 1, 1995, Oaks, PA.

Advanced Polymer Technology, Inc., Poly–Tech Large Mouth Modular Dispenser Sump, Pub. LM201, Apr. 1, 1996, various pages.

Environ Products, Inc., Product Price List, Pub. P–APB–1010, Aug. 15, 1996, Lionville, PA.

Total Containment, Delivering the Difference, PE1100, 1996, Oaks, PA.

Würtemberger, G. (Editor): "Fackunde für Metallberufe" 1981, Europa–Lehrmittel, Wuppertal (DE) XP002053187 see pp. 231–232.

*Primary Examiner*—Dennis L. Taylor
*Attorney, Agent, or Firm*—Dinsmore & Shohl LLP

[57] ABSTRACT

A unitary sump frame made from a continuous material is disclosed. A substantially planar and continuous flange has an inner perimeter defining an opening in the frame and an outer perimeter. A lip is integrally connected to the flange and extends downwardly from the flange. The lip includes a securing mechanism that is operative to attach a component to the frame. A lug is integrally connected to the lip and extends away from the opening. The lug is operative for anchoring the frame.

17 Claims, 6 Drawing Sheets

UNITARY SUMP FRAME

RELATED APPLICATIONS

This application is a continuation of U.S. patent application Ser. No. 08/728,255 filed Oct. 8, 1996.

TECHNICAL FIELD

The present invention relates generally to structural members for sumps, and will be specifically disclosed as a unitary frame for underground sumps.

BACKGROUND

Underground sumps are intended to collect fluids and/or provide access to components below the surface. For instance, sumps are often used in gasoline filling stations to collect spilled fuel and provide access to underground pipes, fittings, machinery and the like. In a typically filling station, fuel is stored in an underground tank and is delivered to fuel dispensers through pipes running below the pavement. Sumps are usually located below the fuel dispensers to collect any leaked or spilled fuel and to provide access to the fuel pipes and associated couplings. Such sumps typically comprise a plastic or metal shell which is buried in backfill and/or cement such that the mouth of the sump is open to air at the level of the surface.

Often, underground sumps include a structural frame surrounding the sump mouth to help provide structural integrity to the sump shell so that the backfill and cement will not collapse the shell during the installation. Additionally, frames provide an anchor in the ground to which components such as shear valves may be attached. Shear valves are designed to automatically close the flow of fuel or vapor in a pipe when the valve is broken or sheared off, which could occur if, for instance, a vehicle ran over the fuel dispenser. Shear valves include an intentional weak point where the valve will break or shear in the event a pipe is exposed to unusual forces. To work correctly, most shear valves should be mounted in the mouth of the sump and must be adequately anchored to assure the valve shears at the correct location.

Frames have been assembled using a variety of components often attached to one another by welding and/or bolting. Beyond adding to the manufacturing costs by including the steps of assembly and attachment, assembled frames often experience accelerated corrosion due to the inherent qualities of welded joints and moisture retention between joined members. These corrosion effects are often aggravated by the salt and moisture resulting from the weather exposure experienced by many filling stations. Additionally, some assembled frames also attach L-shaped brackets to anchor the frame in cement. Such an anchoring scheme can be problematic as the discrete L-shaped brackets provide little surface area to grip the cement. Furthermore, as the brackets corrode the gripping ability is further reduced, which could jeopardize the overall anchoring of the frame. Therefore, there is a need for a frame that overcomes the aforementioned problems.

SUMMARY OF THE INVENTION

Accordingly, an object of this invention is to provide an improved frame.

Another object of the invention is to provide a frame with improved corrosion resistance.

Still a further object of the invention is to provide a frame with improved anchoring ability.

Yet another object of the invention is to provide a frame with reduced manufacturing costs.

Additional objects, advantages and novel features of the invention will be set forth in part in the description that follows and in part will become apparent to those skilled in the art upon examining or practicing the invention. The objects and advantages of the invention may be realized and obtained by means of the instrumentalities and combinations particularly pointed out in the appended claims.

One embodiment of the invention is a unitary frame made from a continuous material, such as a frame formed from a sheet of metal. The unitary frame includes a substantial planar and continuous flange having an inner perimeter defining an opening in the frame and an outer perimeter. A lip is integrally connected to the flange and extends downwardly from the flange. The lip includes a securing mechanism for attaching a component to the frame. One example of a securing mechanism is a hole for receiving a threaded fastener. A lug is integrally connected to the lip and extends away from the opening, preferably parallel to the plane of the flange, and is operative for anchoring the frame. The unitary frame is preferably mounted in cement such that the flange is level with the surface of the cement and the lugs are anchored in the cement. Optionally, a plurality of fasteners extend upwardly through a plurality of corresponding holes in the flange. These fasteners are anchored in the cement and are used to secure a structure, such as a fuel dispenser, to the ground.

Still other aspects of the present invention will become apparent to those skilled in the art from the following description of a preferred embodiment, which is simply by way of illustration one of the best modes contemplated for carrying out the invention. As will be realized, the invention is capable of other different obvious aspects, all without departing from the invention. Accordingly, the drawings and descriptions are illustrative in nature and not restrictive.

BRIEF DESCRIPTION OF THE DRAWINGS

The accompanying drawings, incorporated in and forming part of the specification, illustrate several aspects of the present invention and together with their description serve to explain the principles of the invention. In the drawings.

DETAILED DESCRIPTION

Figure 1:
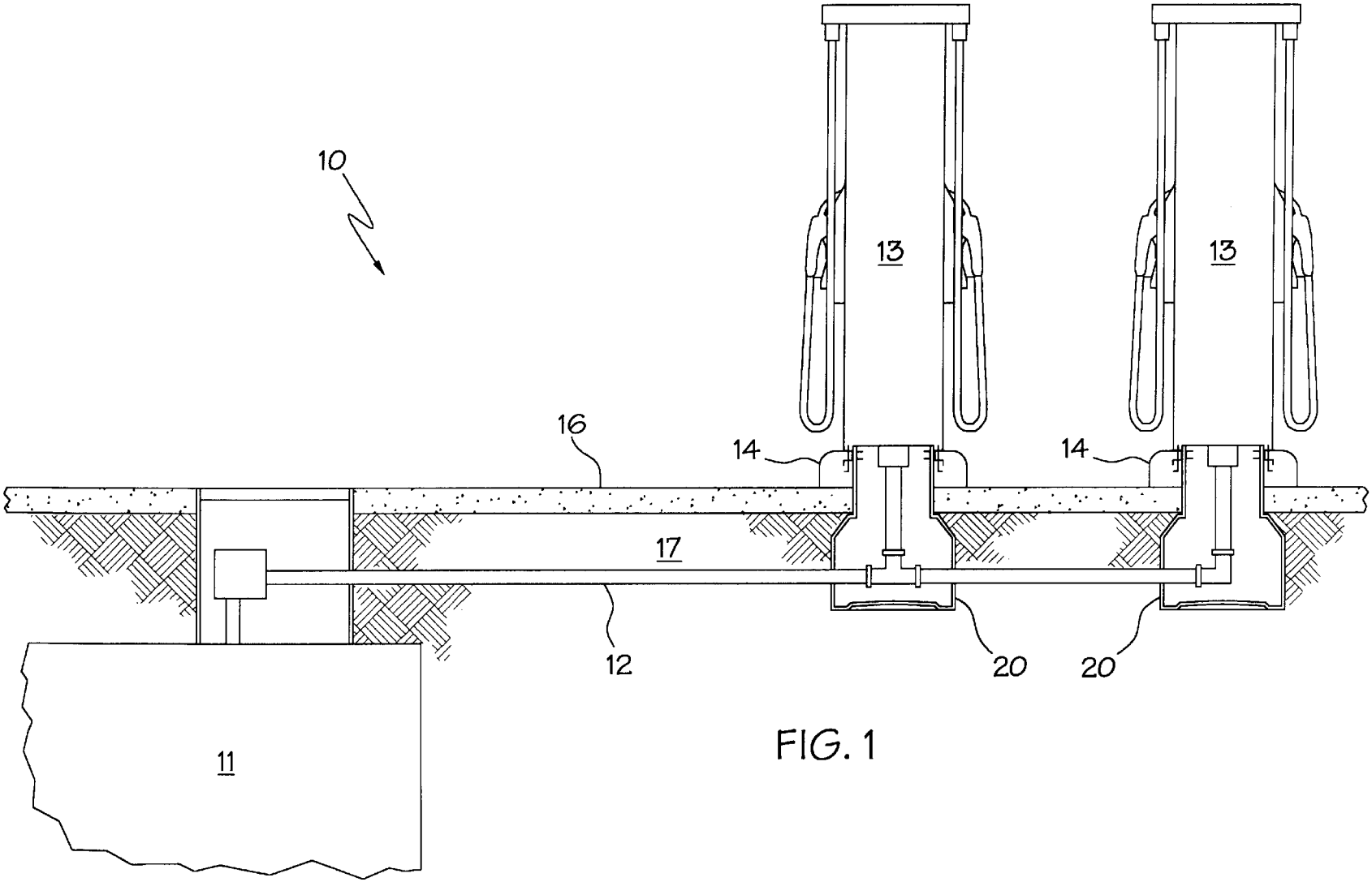
FIG. 1 shows a cross-sectional view of a gasoline filling station.

One embodiment of and application for the invention is illustrated in the figures. FIG. 1 depicts a typical gasoline filling station 10. Fuel from an underground tank 11 is delivered to the fuel dispensers 13 via the fuel pipe 12. The sumps 20 provide a chamber to access the fittings and pipes beneath the surface of the pavement 16. The sump 20 rises up through the island 14 and opens to the inside of the fuel dispenser 13. The sump 20 can be accessed, through doors (not shown) in the fuel dispenser 13 or by removing the fuel dispenser 13 from the island 14. Beyond providing access to underground components, the sump 20 is designed to contain fuel leakage and/or spillage, and prevent any fuel from seeping into the backfill 17. Additionally, the sump 20 prevents groundwater from filling the chamber.

Figure 2:
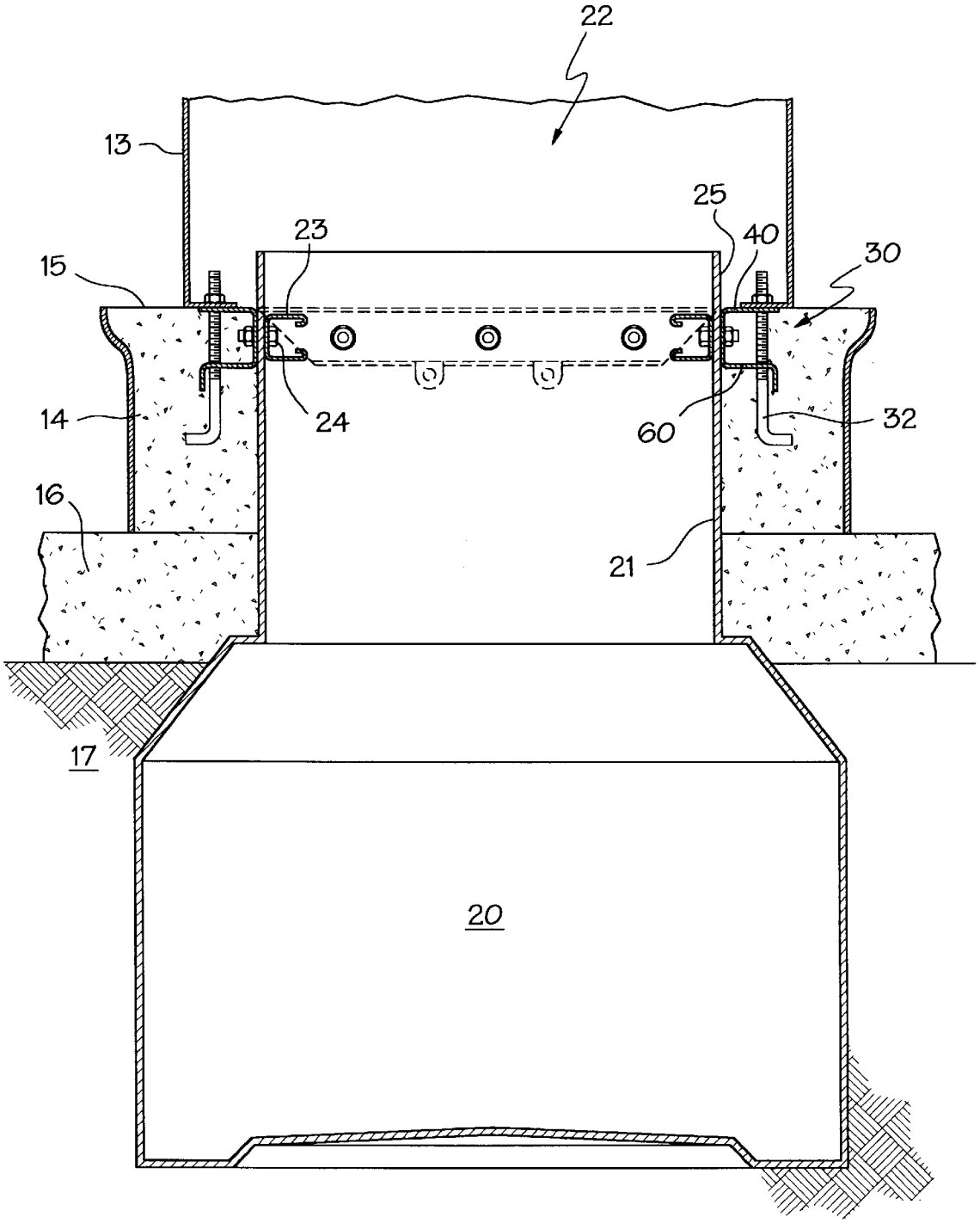
FIG. 2 shows a cross-sectional view of an exemplary use of a sump and frame in connection with a gasoline filling station.

FIG. 2 depicts a cross-sectional view of a sump 20. As is readily apparent, the sump wall 21 defines a chamber below the top surface 15 of the island 14. As shown here, the chamber is pear-shaped, but other shaped sumps may also be used. For instance, shallow rectangular sumps, sometimes referred to as pans, could also be used with the present invention. The lower half of the sump 20 is surrounded by backfill 17. The sump 20 rises up through the pavement 16 and through the island 14, from which the sump mouth 22 opens to the inside of the fuel dispenser 13. The top rim of the sump wall 21 rises slightly above the top surface 15 of the island 14 to form a rain lip 25 that prevents rain water and other liquids from flowing into the sump 20. The sump wall 21 prevents the backfill 17, pavement 16, and island 14 from compromising the general shape of the sump. As the sump 20 is also designed to contain fuel leaks and spills and prevent groundwater from entering the chamber, sump walls 21 are preferably waterproof and resistant to gasoline, and can be made from materials such as plastic, metal, fiberglass, and the like.

A mounting strut 23 and frame 30 are attached to the sump wall 21 using a series of bolts 24. The strut 23 provides a structure upon which stabilizer bars (not shown) may be securely fastened. Shear valves are mounted to these stabilizer bars to provided the requisite structural support for the valves to shear in the event the fuel dispenser 13 is destroyed. Other components can additionally be mounted to the stabilizer bars. Among the other functions, the frame 30 provides an anchor for the struts 23. The lugs 60 are embedded in the island 14 to anchor the frame 30. Additional anchorage can be provided by the bolts 24 which can extend deeply into the island 14. Preferably, the frame 30 circumscribes the sump mouth 22 and includes lugs 60 on all sides to provide maximum anchorage. The flange 40 lies approximately level with the top surface 15 of the island 14. The fuel dispenser 13 mounts on top of the island 14 using the fasteners 32, which are embedded in the island 14. Close alignment of the fasteners 32 to the mating portions of the fuel dispenser 13 is achieved through a plurality of corresponding holes (not shown in this figure) in the flange 40.

Figure 3:
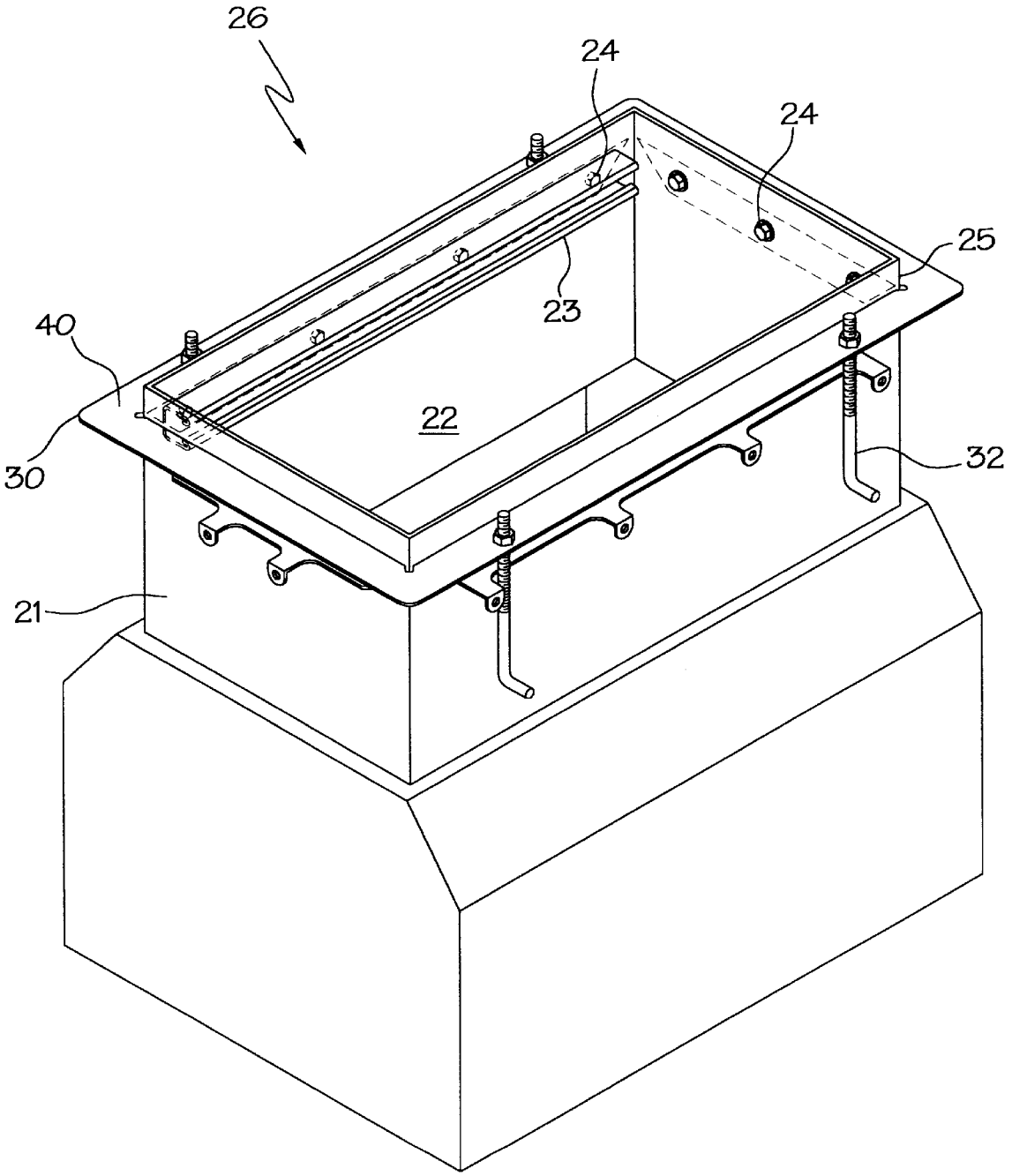
FIG. 3 shows a perspective view of a sump assembly, including a frame, sump wall, and sump strut.
Figure 4:
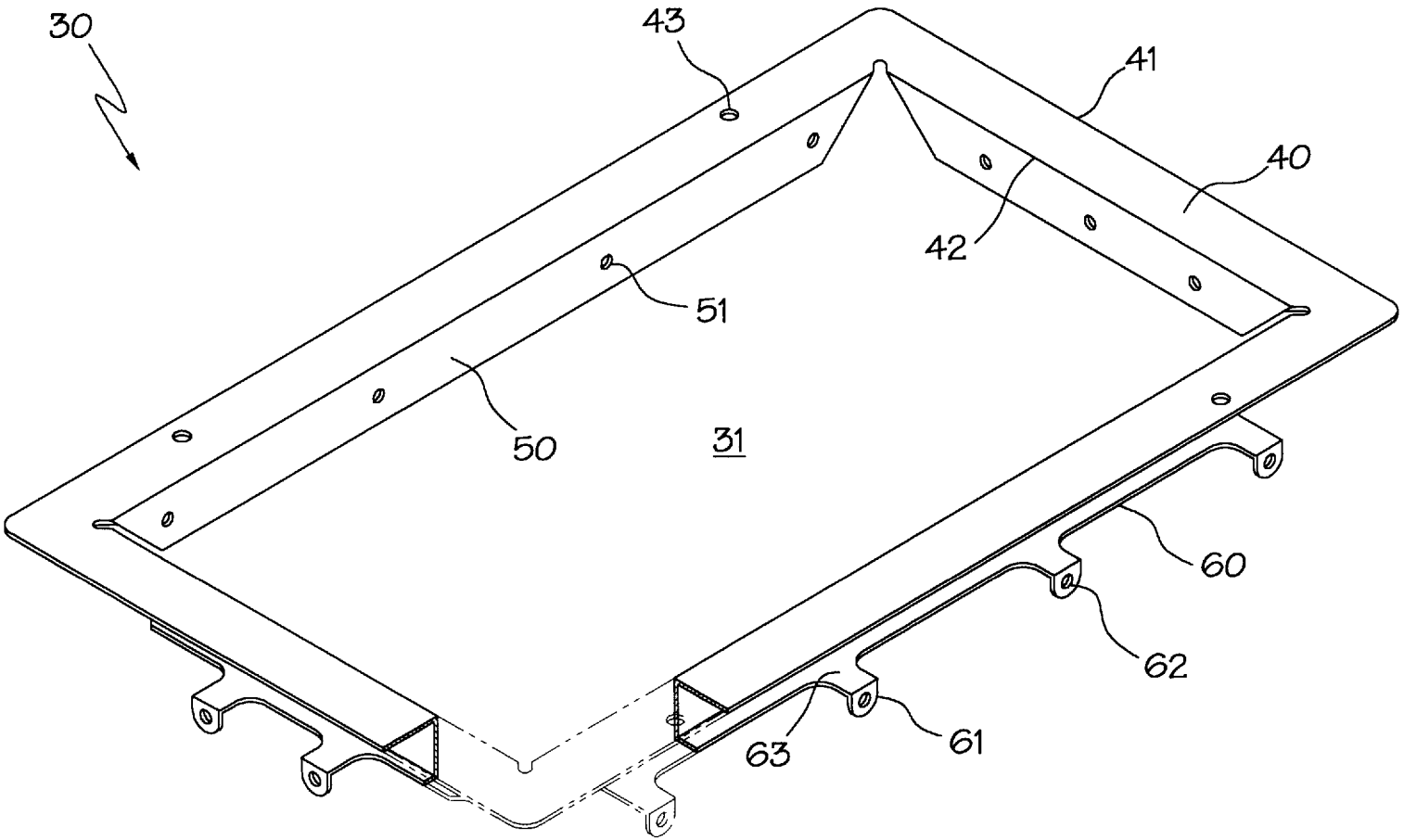
FIG. 4 shows a perspective view of a unitary frame with a comer broken in phantom.
Figure 5:
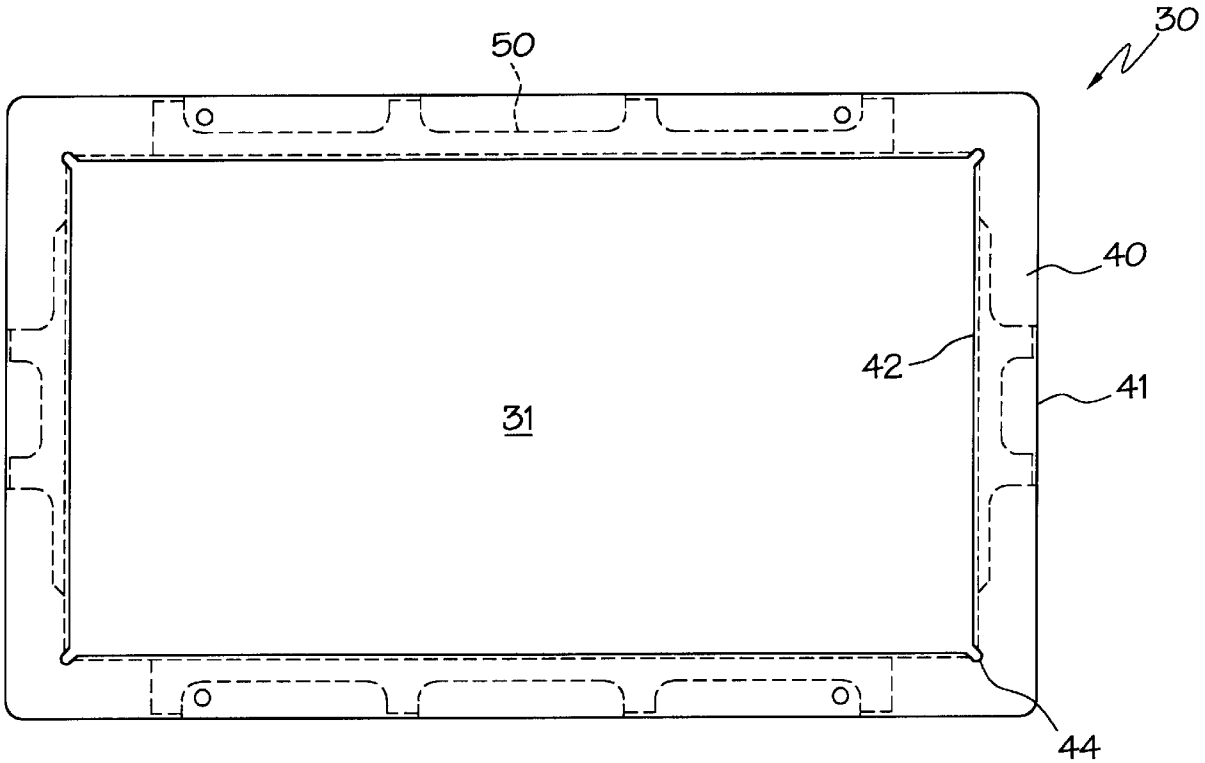
FIG. 5 shows a top view of the unitary frame of FIG. 4.
Figure 7:
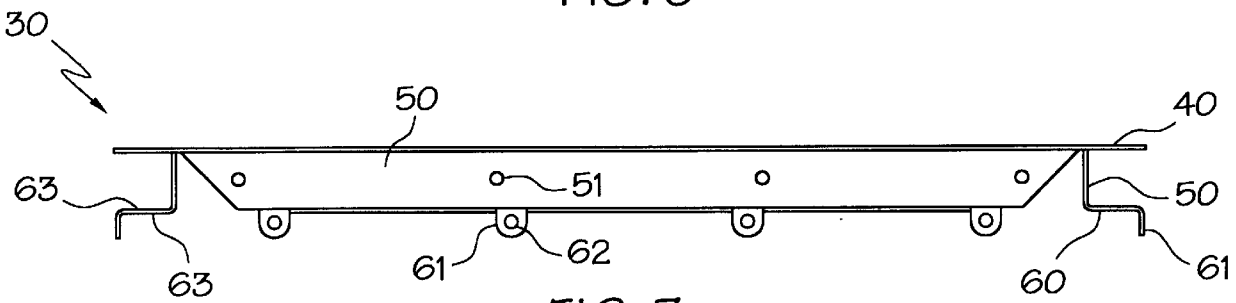
FIG. 7 shows a side view of the unitary frame of FIG. 4.
Figure 6:
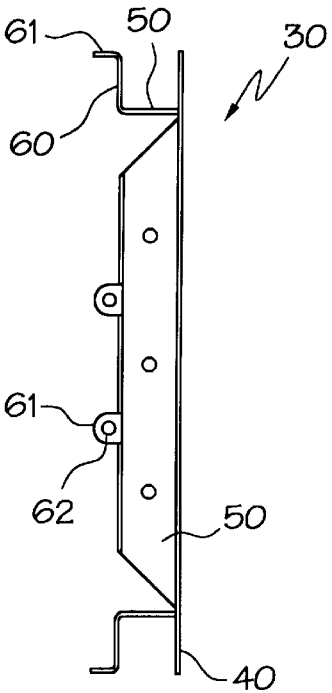
FIG. 6 shows a front view of the unitary frame of FIG. 4.

The sump 20 is installed in the ground by first connecting the frame 30, strut 23, and sump wall 21 together as a sump assembly 26, as shown in FIG. 3. The sump assembly 26 is assembled using a series of bolts 24 which extend outwardly through the strut 23, the wall 21, and the frame 30. A hole is dug in the ground into which the sump assembly 26 is placed. The hole should be deep enough so that the flange 40 will be aligned with the desired level for the top surface 15 of the island 14. Backfill 17 is placed in the hole to a predetermined level. Pavement 16 is then poured over the backfill 17 and around the sump 20. Next, the island 14 is poured such that the top surface 15 is level with the flange 40. Preferably, the pavement 16 and island 14 are formed from concrete, however, other materials such as asphalt may be used. The frame 30, which circumscribes the sump mouth 22, adds structural integrity to the sump wall 21 during the installation process. Specifically, as the backfill 17, pavement 16 and island 14 are poured around the sump wall 21, the frame 30 prevents the weight of these materials from collapsing the sump mouth 22.

The sump assembly 26 also includes a series of fasteners 32, shown here as L-bolts, extending up through the flange 40. These fasteners 32 are used for mounting structures, such as the fuel dispenser 13, to the ground. Close alignment with the mating portions of the fuel dispenser 13 is achieved by corresponding holes (not shown in the figure) in the flange 40. During the pouring of the pavement 16 and the island 14, the fasteners 32 become anchored in the ground.

FIGS. 4–7 illustrate several views of a unitary frame 30. The frame 30 includes a substantially planar and continuous flange 40 having an outer perimeter 41 and an inner perimeter 42. While shown here as a flat surface, the flange 40 could have a variety of shapes and features, such as a rounded brim, a raised lip, a trough, or the like. The flange 40 is planar to the extent that the circumference of the flange 40 defines a substantially flat imaginary surface. The inner perimeter 42 defines an opening 31 in the frame 30 which is preferably polygon-shaped, such as the rectangle shown in the embodiment of FIG. 4. Other shaped openings, including circular, square, hexagonal, octagonal, etc. may alternatively be used.

A lip 50 is integrally connected to the flange 40 and extends downwardly from the flange 40. Preferably, the lip 50 extends from the inner perimeter 42 of the flange 40 substantially perpendicular to the plane of the flange 40, however, any angle or rounded transition is also acceptable. As depicted here, the frame 30 includes a plurality of discrete lips 50, the number of which corresponds to the number of sides in the polygon-shaped openings 31. A relief 44 is located in the flange 40 between each lip 50 where the lip extends downwardly from the flange 40. The lip 50 further includes a securing mechanism 51 to attach other components, such as the sump wall 21 and strut 23, to the frame 30. As shown here, the securing mechanism 51 comprises a series of holes for receiving threaded fasteners, such as the assembly bolts 24 depicted in FIGS. 2 and 3. Other securing mechanisms may be employed, such as weld surfaces, rails, screws, rivets, hooks, adhesion surfaces, and the like.

The frame 30 also comprises a lug 60 integrally connected to the lip 50. The lug 60 extends away from the opening 31, and is preferably parallel to the plane of the frame 40. The lug 60 is operative for anchoring the frame 30 in the ground, which in the embodiment of FIG. 2 is the cement of the island 14. Preferably, the lug 60 includes a grip area 63 extending along the substantial length of the lip 50 for gripping and/or anchoring the lug 60 in the cement. Alternative or supplemental anchoring can be provided by a plurality of tabs 61. While the tabs 61 could extend the entire length of the lip 50, it is preferable that the tabs 61 be intermittently spaced to allow the poured island 14 to flow around and completely interface with the lug 60 during the installation of the sump 20. Optionally, each tab 61 includes a hole 62 extending therethrough to maximize anchoring to the island 14.

Figure 8:
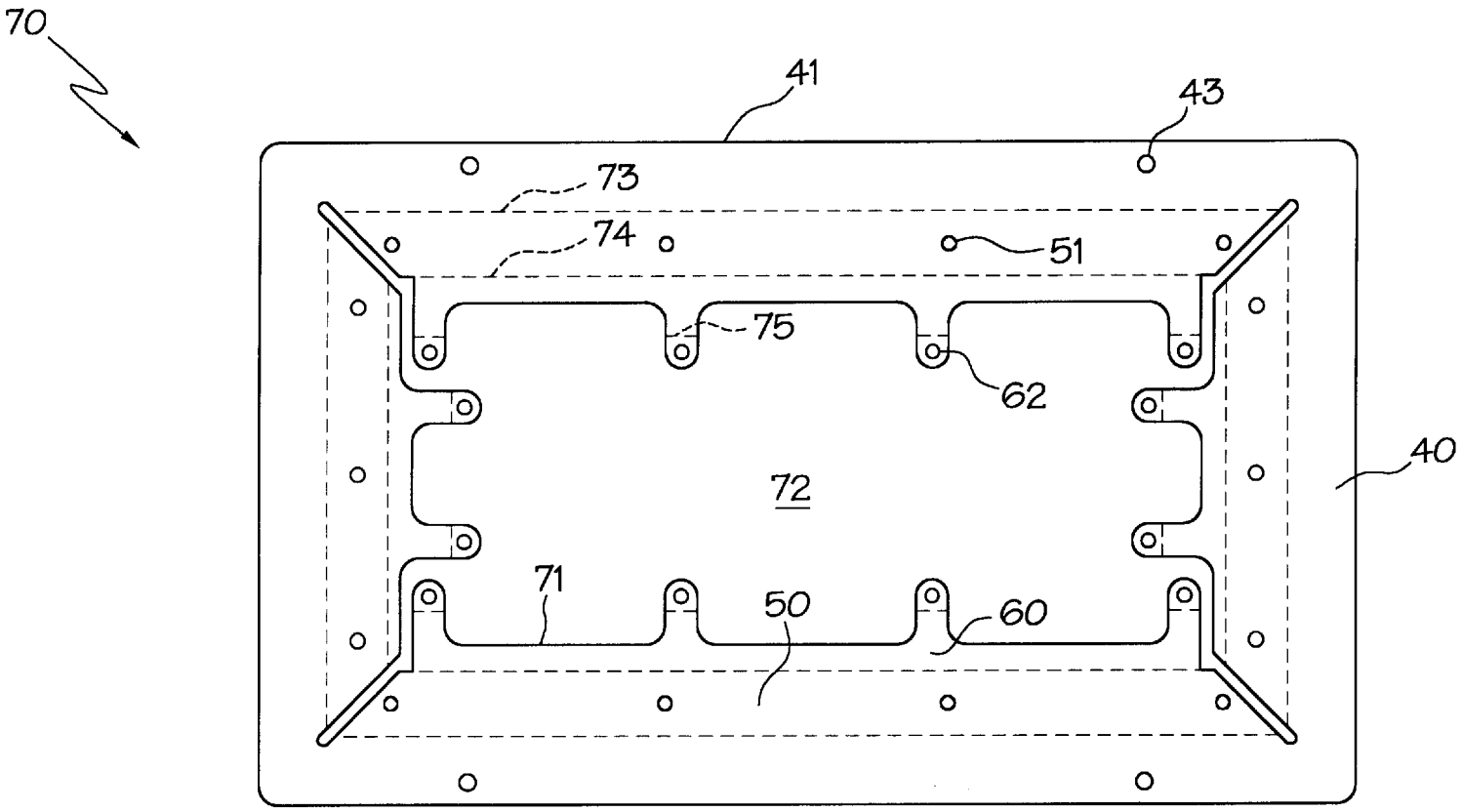
FIG. 8 shows a top view of a continuous material used to make a unitary frame.

The flange 40, lip 50 and lug 60 are all made from a continuous material. For the purposes of this specification and claims, "continuous material" means that two or more components share a homogeneous continuum of the same material. Therefore, continuous material includes a formed sheet of material, parts molded from powdered metals or resins, castings, plastics, forging and the like. As shown in FIG. 8, the flange 40, lips 50, and lugs 60 are preferably formed from a single sheet of material 70, such as metal. The sheet of material 70 is first shaped to define the outer perimeter 41 of the flange 40. Next, the sheet of material 70 is cut along a predetermined closed path 71 to form a bounded pattern area 72 in the sheet of material 70. The exact cutting mechanism will depend upon the material of the sheet 70. For instance, if the sheet 70 is steel, an NC plasma arc machine could be used to cut the path 71.

Next, the portion of the sheet material within the bounded pattern area 72 is separated from the remainder of the sheet of material 70. Optionally, the next step involves cutting or drilling a plurality of holes in the remainder of the sheet material to provide features in the frame 30 such as the fastener holes 43, the fastening mechanism 51, and the tab holes 62. The remainder of the sheet of material 70 is then bent at predetermined locations. The bend locations can be straight or curved, and the bends themselves can be sharp or rounded at any one of a variety of angles or curves, however, it is preferred that each bend be about 90 degrees. In the embodiment of FIG. 8, the bend location 73 defines the inner perimeter 42 of the flange 40, the bend location 74 defines where the lug 60 extends from the lip 50, and the bend location 75 defines the tab 61.

The resulting unitary frame 30 can be manufactured quickly and inexpensively, and requires little or no assembly. Additionally, the unitary frame 30 has no weld joints thus providing improved corrosion resistance. The lugs 60 also provide superior anchoring due to the extended grip area 63 which will grip the ground, which is supplemented by the anchoring provided by the tabs 61.

The foregoing detailed description of the invention has been presented for purposes of illustration and description. It is not intended to be exhaustive nor limited the invention to the precise form disclosed. Many alternatives, modifications and variations will be apparent to those skilled in the art in light of the above teaching. For instance, the present invention is not limited to sumps per se, and can be used in conjunction with virtually any opening in which a frame is desirable. Additionally, the frame need not be used to anchor shear valves or in conjunction with filling stations. Accordingly, this invention is intended to embrace all such alternatives, modifications and variations that fall within the spirit and broad scope of the appended claims and their equivalents.

What is claimed:

1. An unitary sump frame, comprising:

a) a substantially planar and continuous flange for circumscribing the mouth of an underground sump, said flange having an outer perimeter and an inner perimeter, the inner perimeter defining a polygon-shaped opening;

b) a plurality of discrete lips, the number of which corresponds to the number of sides in the polygon-shaped opening, each lip being integrally connected to the flange and extending downwardly from the inner perimeter of the flange, at least one of said plurality of lips including a hole for receiving a fastener; and c) a lug integrally connected to each lip and extending away from the opening, said lugs being operative for anchoring the frame in the ground;

said flange, plurality of lips, and lugs being formed from a single sheet of material.

2. A sump frame as recited in claim 1, further comprising a plurality of fasteners extending upwardly through a plurality of corresponding holes in the flange, said fasteners being adapted for anchoring in the ground and securing a structure to the ground.

3. A sump frame as recited in claim 1, wherein each lug comprises a plurality of intermittent tabs.

4. A sump frame as recited in claim 1, wherein the sump frame is designed to be mounted in cement such that the flange is level with the surface of the cement and the lugs are anchored in the cement.

5. A filling station island, comprising:

a) a top surface formed at least partially from concrete;

b) a sump having a sump wall defining a chamber located below the top surface;

c) at least one fuel dispenser mounted on the top surface; and (d) a unitary sump frame comprising a substantially planar and continuous member having an outer perimeter and an inner perimeter, a lip extending downwardly from the inner perimeter of the member, and one or more lugs extending from the lip, said member, lip, and lugs sharing a homogeneous continuum of material;

said frame being attached to the sump wall and the lugs being anchored in the concrete.

6. A filling station island as recited in claim 5, wherein the inner perimeter defines a polygon-shaped opening.

7. A filling station island as recited in claim 6, further comprising a plurality of lips, the number of which corresponds to the number of sides in the polygon-shaped opening.

8. A filling station island as recited in claim 5, wherein the frame comprises a plurality of discrete lips.

9. A filling station island as recited in claim 8, wherein the member includes a relief located between each lip where the lip extends from the member.

10. A filling station island as recited in claim 5, wherein the one or more lugs comprise a plurality of intermittent tabs.

11. A filling station island as recited in claim 10, wherein each tab includes a hole extending therethrough.

12. A filling station island as recited in claim 5, further comprising a plurality of fasteners extending upwardly through a plurality of corresponding holes in the member, said fasteners being adapted for securing a structure.

13. A filling station island as recited in claim 12, wherein the structure is the fuel dispenser.

14. A filling station island as recited in claim 5, wherein the lip comprises a plurality of holes and the sump wall is attached to the frame using threaded fasteners extending through the holes.

15. A filling station island as recited in claim 5, wherein the lip extends from the inner perimeter substantially perpendicular to the plane of the member.

16. A filling station island as recited in claim 5, wherein the one or more lugs extend from the lip and substantially parallel to the plane of the member.

17. A filling station island as recited in claim 5, wherein the member, lip, and lugs are formed from a single sheet of material.

* * * * *